US005803136A

United States Patent [19]

Hartsell, Jr.

[11] Patent Number: 5,803,136

[45] Date of Patent: Sep. 8, 1998

[54] FUEL TANK ULLAGE PRESSURE REDUCTION

[75] Inventor: Hal C. Hartsell, Jr., Kernersville, N.C.

[73] Assignee: Gilbarco Inc., Greensboro, N.C.

[21] Appl. No.: 715,455

[22] Filed: Sep. 18, 1996

Related U.S. Application Data

[60] Provisional application No. 60/003,982, Sep. 19, 1995.

[51] Int. Cl.[6] ..... B65B 31/00

[52] U.S. Cl. ..... 141/7; 141/4; 141/59; 137/583; 137/589

[58] Field of Search ..... 137/583, 587, 137/588, 589; 141/4, 5, 7, 44, 52, 59; 422/110, 168, 177, 122

[56] References Cited

U.S. PATENT DOCUMENTS

| | | | |
|---|---|---|---|
| 3,581,782 | 6/1971 | Onufer | 141/59 |
| 4,058,147 | 11/1977 | Stary et al. | 141/45 |
| 5,040,577 | 8/1991 | Pope | 141/59 |
| 5,195,564 | 3/1993 | Spalding | 141/1 |
| 5,229,079 | 7/1993 | Harada et al. | 422/174 |
| 5,333,655 | 8/1994 | Bergamini et al. | 141/59 |
| 5,464,466 | 11/1995 | Nanaji et al. | 95/45 |
| 5,484,000 | 1/1996 | Hasselmann | 141/7 |
| 5,562,133 | 10/1996 | Mitchell | 141/206 |

OTHER PUBLICATIONS

OPW Fueling Components Brochure entitled "ORVR/Stage II Compatibility: Keeping Onboard and Vac–Assist Systems From Pulling in Opposite Directions" Undated, but date believed to be Jul., 1997.

*Primary Examiner*—Jeffrey Stucker
*Attorney, Agent, or Firm*—Rhodes Coats & Bennett, L.L.P.

[57] ABSTRACT

An apparatus for reducing the pressure in a fuel tank ullage includes a conduit adapted to be connected to the fuel tank ullage and equipped with a controllable valve. A pressure sensor is adapted for mounting to detect the pressure in the fuel tank ullage, and a catalyst module has an inlet connected to the conduit, a catalyst in the module, an outlet separated from the inlet by the catalyst, a heater disposed to heat the catalyst, and a temperature sensor to detect the temperature of the catalyst. A controller is adapted to receive inputs from the pressure sensor and the temperature detector and output control signals to the heater to heat the catalyst when the pressure sensor indicates the pressure in the ullage exceeds a threshold and to open the controllable valve after the temperature sensor indicates the catalyst has reached a temperature at which it catalyzes volatile hydrocarbons to permit movement of vapor and air from the ullage to the catalyst for oxidation of the vapor and discharge of the oxidation products and air to the atmosphere, thereby reducing the pressure in the ullage.

8 Claims, 3 Drawing Sheets

FUEL TANK ULLAGE PRESSURE REDUCTION

BACKGROUND OF THE INVENTION

This application claims the benefit of U.S. Provisional application Ser. No. 60/003,982, filed Sep. 19, 1995.

The present invention relates to improvements in an apparatus for reducing the pressure in the ullage of a fuel tank to prevent fugitive emissions of polluting hydrocarbon vapors.

Vapor recovery fuel dispensers have been common in California for some time, and the Clean Air Act of 1990 has mandated their use in many other localities across the United States. The development of vapor recovery fuel dispensers began in the early '70's and included some dispensers that had assist-type mechanisms for pumping the vapors to the underground storage tank in service stations. These did not generally gain favor and, throughout the 1970's and 1980's, balance system vapor recovery fuel dispensers were more common. In the balance system, a closed, sealed path is established between the fuel tank being filled and the underground tank. The movement of the liquid from the underground tank to the automobile tank creates a higher pressure area in the automobile tank and a lower pressure area in the underground tank to induce the vapor to move from the automobile tank to the underground tank. The systems were merely tolerated, because they were very cumbersome and prone to failure.

In the 1990's, new vapor recovery fuel dispensers are often equipped with vapor pumps to actively pump the vapor to the underground storage tank, as embodied in the VAPORVAC® line of dispensers manufactured and sold by Gilbarco, Inc., Greensboro, N.C., the assignee of the present application. Such active, assisted systems are also sold by the Wayne Division of Dresser Industries under the name WAYNEVAC®, and by Tokheim Corporation of Fort Wayne, Ind. under the name MAXVAC®.

These systems are exemplified by numerous issued U.S. Pat. Nos. including 5,040,577 to Pope, 5,195,564 to Spalding, and 5,333,655 to Bergamini. The disclosures of these three patents are incorporated herein by reference.

The assisted vapor recovery systems of the 1990's have proven to be very capable of transporting the vast majority of the vapor from the filler pipe of the automobile to the underground storage tank. However, in some cases, the act of pumping of the vapor can lead to pressurization of the underground storage tanks and associated piping. The underground storage tanks and piping have an area above the liquid known as the ullage, in which air and fuel vapors reside. The pressurized air and fuel vapors will have a tendency to leak out of any hole in the tank or piping of the system, thus allowing the release of the polluting fuel vapor to the atmosphere, precisely the situation that the vapor recovery fuel dispensers are intended to avoid.

It has also been found that the balance systems which have been in use for so many years can be subject to fugitive emissions of this sort. Various pressure changes can occur in the tank, regardless of whether there is pumping going on, including diurnal temperature changes and the like, leading to an overpressure in the underground tank. These overpressures are of concern, since the result can be fugitive emissions of pollutants to the atmosphere.

The assignee of the present applicant addressed this problem in pending application 08/153,528 filed Nov. 16, 1993. The entire disclosure of that application is incorporated herein by reference. That prior application discloses a fuel storage tank vent filter system in which vapors from the underground tanks are directed to a chamber having a fractionating membrane. The membrane permits transmission of hydrocarbons through it in preference differentially to atmospheric vapors. That system calls for a pump to be arranged to draw the pollutants through the membrane as permeate and redirect them to the underground tank, permitting air as retentate to be released to the vent pipe of the service station tank arrangement.

However, alternate systems to remove volatile hydrocarbons from the ullage may also prove useful in reducing the pressure in the ullage to reduce the risk of fugitive emissions. The present invention provides such an alternate which may provide a system that is less expensive and easier to maintain than the membrane-based system.

SUMMARY OF THE INVENTION

The present invention provides an apparatus for reducing the pressure in a fuel tank ullage includes a conduit adapted to be connected to the fuel tank ullage and equipped with a controllable valve. A pressure sensor is adapted for mounting to detect the pressure in the fuel tank ullage, and a catalyst module has an inlet connected to the conduit, a catalyst in the module, an outlet separated from the inlet by the catalyst, a heater disposed to heat the catalyst, and a temperature sensor to detect the temperature of the catalyst. A controller is adapted to receive inputs from the pressure sensor and the temperature detector and output control signals to the heater to heat the catalyst when the pressure sensor indicates the pressure in the ullage exceeds a threshold and to open the controllable valve after the temperature sensor indicates the catalyst has reached a temperature at which it catalyzes volatile hydrocarbons to permit movement of vapor from the ullage to the catalyst for oxidation, thereby reducing the pressure in the ullage. The oxidation converts the hydrocarbons to water and carbon dioxide, which can be safely vented to the atmosphere.

A vapor pump may be associated with the conduit to transport vapors from the ullage through the conduit to the catalyst module, with the controller adapted to actuate the vapor pump when the valve is opened.

The invention also provides a method of reducing the pressure in a fuel tank ullage including the steps of detecting the pressure in the fuel tank ullage, when the pressure exceeds a threshold, heating a catalyst to a temperature at which it catalyzes volatile hydrocarbons, withdrawing vapor from the fuel tank ullage, directing the withdrawn vapor to the catalyst for oxidation to carbon dioxide and water, and discharging the oxidation products.

BRIEF DESCRIPTION OF THE DRAWINGS

The invention will be better understood after a reading of the Detailed Description of the Preferred Embodiments and a review of the drawings in which.

DETAILED DESCRIPTION OF THE PREFERRED EMBODIMENT

Figure 1:
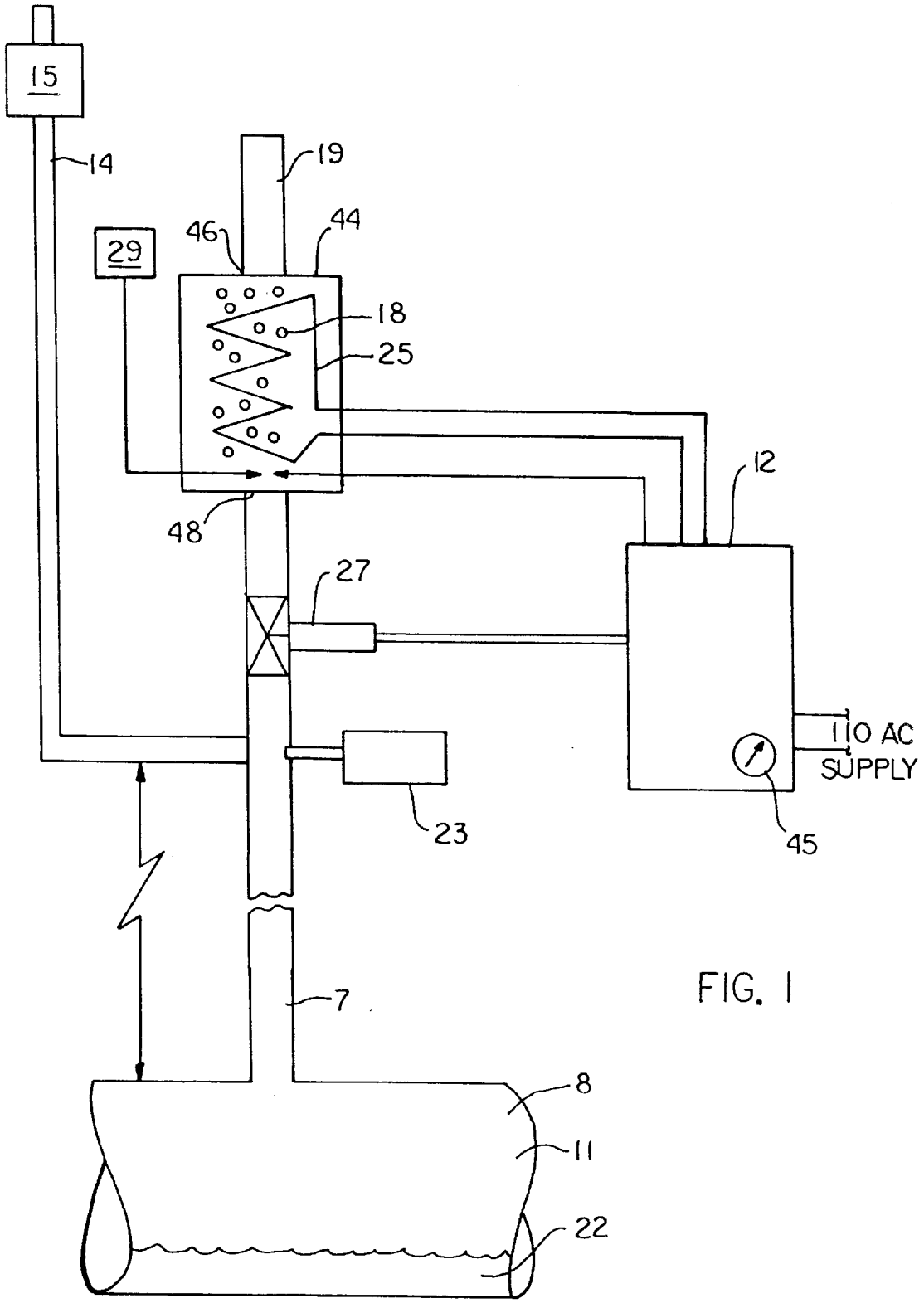
FIG. 1 is a schematic view of the components of one embodiment of the invention.

Referring now to FIG. 1, there is shown a storage tank 8 which is typically underground, but need not be an underground tank for purposes of this invention. The tank 8 holds a liquid fuel 22 such as gasoline. Above the liquid 22 in the tank 8 is a volume 11 known as the ullage holding vapor within the tank 8. The ullage contains, as well, vapors recovered from automobile fuel tanks via a vapor recovery system. The vapor recovery system may be an assist system like the VaporVac system sold by Gilbarco, Inc. of Greensboro, N.C., the WayneVac system sold by Wayne division of Dresser Industries, Inc. or the MaxVac system sold by Tokheim Corp. of Fort Wayne, Ind. Other assist systems or the balance system may also be used. The other contents of the ullage 11 will be vapors of the liquid fuel 22 and, typically, air. The air arrives in the tank 8 through numerous possible paths. First and foremost is through the vapor recovery mechanism of an attached fuel dispenser, not shown, such as the fuel dispensers discussed above. Air might also be ingested through pressure vacuum valve 15 atop vent pipe 14. If the pressure in the ullage 11 falls to a low level, the pressure vacuum valve 15 opens in conventional fashion to permit air to be ingested and avoid potentially dangerous underpressure in the tank 8.

As depicted in FIG. 1, the vent pipe 14 forms part of a conduit 7 leading from the ullage 11 to a catalyst module 44. The catalyst module 44 has an inlet 48 to the intake conduit 7 and an outlet 46.

A catalyst 18 is located in the module 44 so that the inlet 48 and outlet 46 are on the opposite side of the catalyst. The catalyst is disposed in the module 44 so as to provide a catalyst surface area available for contact by the vapors as they move from the inlet 48 to the outlet 46. The outlet 46 communicates to atmosphere through vent pipe 19 connected to release air and oxidation products to atmosphere and thus reduces the mass of vapor and air in the ullage and, hence, the pressure. A heater 25, such as a resistive element, is present in the catalyst module 44 in proximity to the catalyst 18 to heat the catalyst when desired. A temperature sensor 29 is also in proximity to the catalyst to provide a feedback signal of the heating that has occurred.

The catalyst 18 may be any suitable catalyst having the capability to convert volatile hydrocarbons to less noxious components, such as carbon dioxide and water, by oxidation. Suitable catalysts may include those used for catalytic converters in automobiles. Also, Englehard Corporation of Iselin, N.J. has recently announced the development of a platinum-based catalyst it is marketing under the name PremAir, and promoting for use as a coating for automobile radiators to clean ambient air. This catalyst may be suitable.

Associated with the tank 8 or conduit 7 is a pressure sensor 23 to monitor the pressure within the tank. It outputs a pressure signal to an electronic controller 12. The controller 12 can be a suitable controller such as a programmable controller or other microprocessor based control. Those of ordinary skill in the art will realize that the controller may be made using various forms of analog or digital electrical circuits or perhaps pneumatic, hydraulic, mechanical or fiber optics technology. The controller 12 has outputs to the heater 25 and the solenoid valve 27. It also receives the temperature signal from sensor 29.

Figure 2:
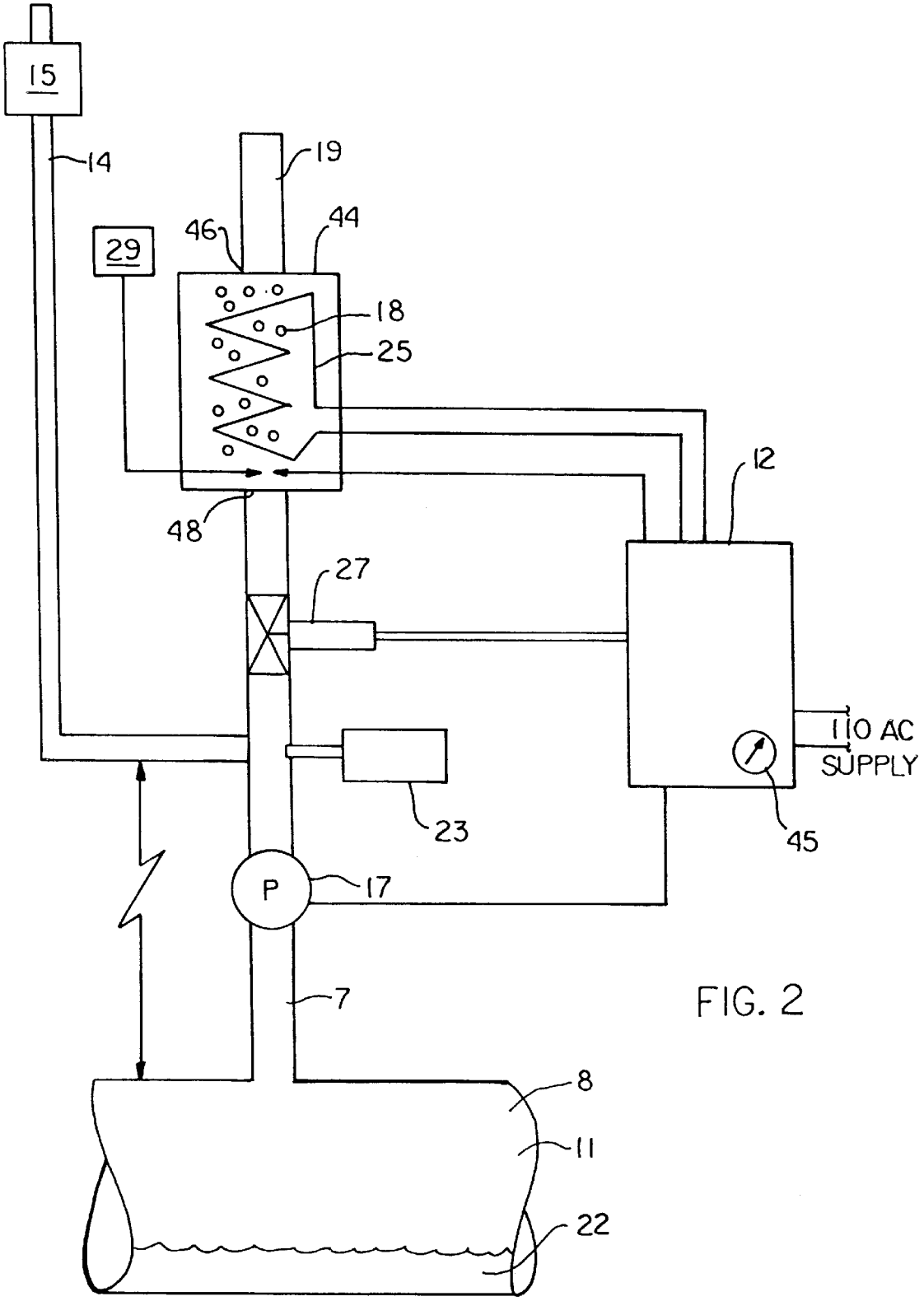
FIG. 2 is a schematic view of the components of an alternate embodiment of the invention.

FIG. 2 shows a system identical to the system of FIG. 1, except that the conduit 7 is equipped with a vapor pump 17, and the controller 12 has a control output line to the vapor pump 17. The vapor pump aids in movement of the vapor from the ullage to the catalyst module 11 if the pressure in the ullage is not great or if it is desired to take the ullage pressure to a very low, perhaps even negative, pressure.

In operation, the system in FIG. 1 operates as follows: the electronic control 12, through the pressure sensor 23, monitors the pressure in tank 8. When the pressure exceeds a threshold, the electronic control 12 turns on the heater 25. When the temperature sensor 29 in the catalyst indicates that the temperature has reached an operating temperature for the catalyst, this is input to the controller 12. The controller 12 then sends a signal to the solenoid valve 27 to open and permit the pressurized vapor to flow from the ullage through the conduit to the catalyst module 44, and into contact with the catalyst 18. In the embodiment of FIG. 2, this is aided by the operation of vapor pump 17, controlled to operate by the controller 12 at about the same time as the opening of the valve 27.

Under certain conditions, water vapor that results from the oxidation of the gasoline vapor and/or water vapor present in the air may condense in the catalyst module. This may require the addition of a liquid drain to avoid water build-up in the module.

Figure 3:
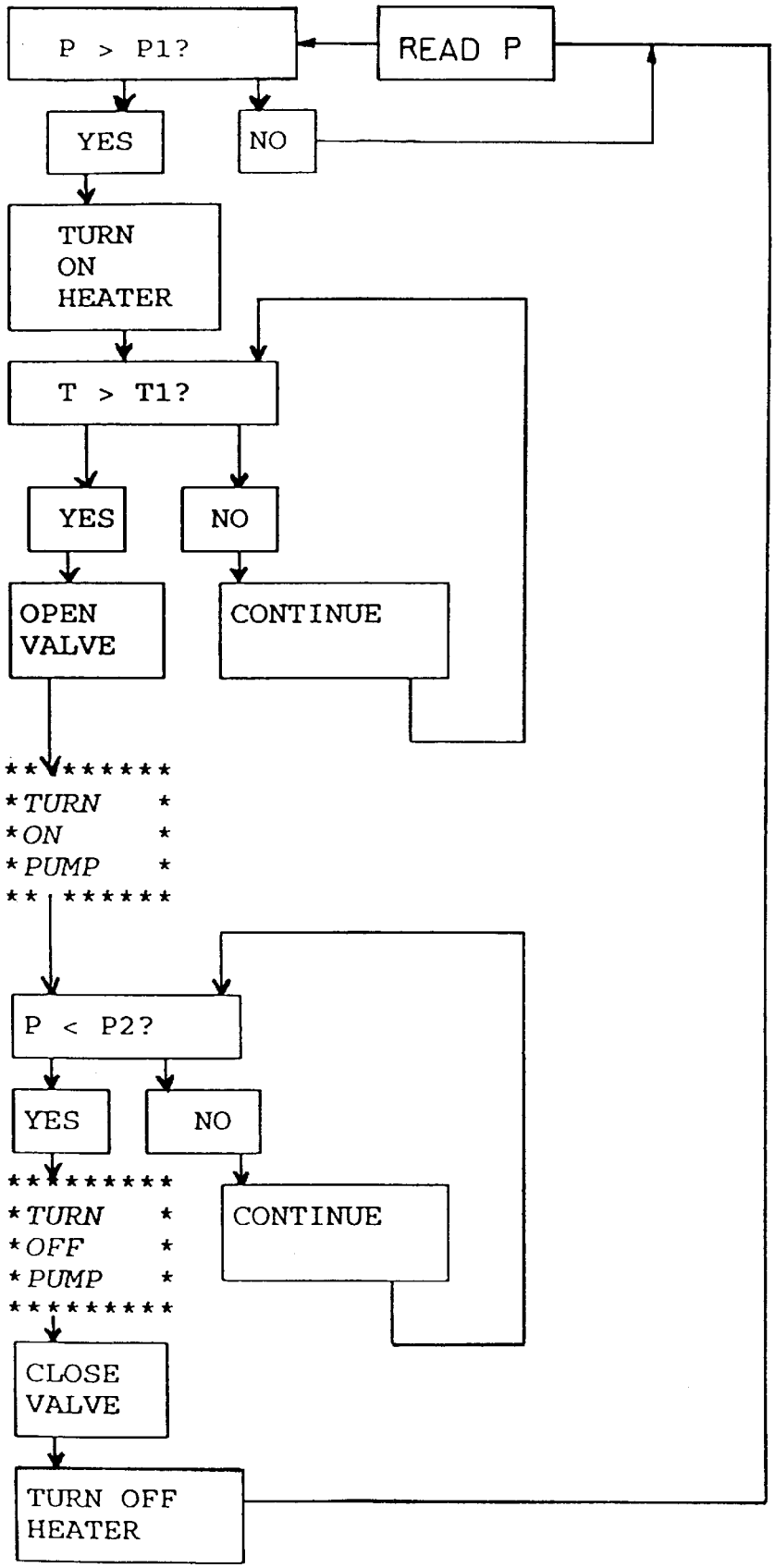
FIG. 3 is a flow chart showing the processing of the apparatus depicted in FIGS. 1 and 2.

Referring now to FIG. 3, the processing of the apparatus can be seen in flow chart form. Starting at the top of the figure, the pressure P from pressure gauge 23 is read and compared to a predetermined threshold or limit P1 by controller 12. If the pressure does not exceed the predetermined limit P1, then the controller 12 keeps the system turned off. If it exceeds the determined limit, the system is turned on by turning on the heater 25, which raises the temperature T of the catalyst. Then, when the temperature reaches the needed threshold T1, the controller responds by opening the valve 27 and turning on the pump 17, should it be present. This pumping by the pump 17 will extract vapors from the ullage 11 and deliver them to proximity with the catalyst 18. In the embodiment of FIG. 1, without the pump 17, the pressure difference between the ullage and atmosphere moves the vapor to the catalyst module. The heated catalyst will oxidize the volatile hydrocarbons with oxygen present in the air component of the ullage vapors to carbon dioxide and water and allow other components of air to pass relatively unaffected.

This situation continues, with the controller 12 continuing to monitor the pressure P see if it has dropped to a lower level P2. When that condition is satisfied, the controller 12 signals the pump 17 (if present) to turn off, valve 27 to close and heater 25 to turn off. This represents the completion of one cycle, and the pressure monitoring for P>P1 resumes.

The electronic control 12 may be provided with an internal timer 45 which can be used for several purposes. First, it can measure the rate of the pressure drop in the tank 8 by comparing the readings from the pressure sensor 23 over time and gauge the effectiveness of the operation by the rate of pressure drop. Second, the time of the operation can be monitored to see that it does not exceed a predetermined threshold. Obviously, if the reduction in pressure should only take five minutes under normal conditions, but the system has continued to operate for, say, ten minutes, it can be ascertained that a problem has occurred and the system can be shut down by controller 12.

In the embodiment of FIG. 2, pump 17 can be a variable speed pump. This permits the speed of pump 17 to be controlled by controller 12 so that the rate of delivery of vapor to the upstream side of the catalyst 18 is optimum for complete oxidation of the hydrocarbons by increasing the residence time of the vapor in proximity to the catalyst. Of course, the equivalent of controlling a variable speed pump 17 can be obtained by reducing the opening of a proportional or solenoid valve in series with a constant speed pump, also directed by the electronic control 12.

Those of ordinary skill in the art will appreciate that there are various modifications to the precise components described above which can be made to the system and still fall within the scope of the invention.

What is claimed is:

1. An apparatus for reducing the pressure in a fuel tank ullage comprising a vapor return pump whose inlet is in communication with a fuel dispensing nozzle and whose outlet is in communication with a vapor return conduit connected to the fuel tank ullage, a vapor processing conduit adapted to be connected to the fuel tank ullage and equipped with a controllable valve, a pressure sensor adapted for mounting to detect the pressure in the fuel tank ullage, a catalyst module having an inlet connected to said vapor processing conduit, a catalyst in said module, an outlet separated from said inlet by said catalyst, a heater disposed to heat said catalyst, and a temperature sensor to detect the temperature of said catalyst, a vapor processing pump associated with said fuel tank ullage to transport vapors from the ullage to said catalyst module through said vapor processing conduit, and a controller adapted to receive inputs from said pressure sensor and said temperature detector and output control signals to said heater to heat said catalyst when said pressure sensor indicates the pressure in the ullage exceeds a threshold and to open said controllable valve to permit withdrawing of volatile hydrocarbons and air from the ullage to said catalyst for oxidation of the volatile hydrocarbons after said temperature sensor indicates said catalyst has reached a temperature at which it catalyzes the oxidation of volatile hydrocarbons to water and carbon dioxide, thereby reducing the pressure in the ullage by oxidation of the volatile hydrocarbons to water and carbon dioxide and release of the water and carbon dioxide and air to atmosphere.

2. The apparatus of claim 1 wherein said vapor processing pump is a variable speed pump whose speed is varied by said controller responsive to the pressure sensed in the fuel tank ullage.

3. The apparatus of claim 1 wherein said vapor processing pump is a variable speed pump whose speed is varied by said controller responsive to the pressure differential between the pressure in the fuel tank ullage and atmospheric pressure.

4. A method of reducing the pressure in a fuel tank ullage having a higher pressure than atmospheric pressure comprising the steps of detecting the pressure in the fuel tank ullage, when the pressure exceeds a threshold, heating a catalyst to a temperature at which it catalyzes volatile hydrocarbons, withdrawing vapor and air from the fuel tank ullage by means of the pressure differential between the tank ullage and atmospheric pressure by opening a valve in communication with an outlet, directing the withdrawn vapor and air to the catalyst for oxidation of the vapor to carbon dioxide and water, and discharging the oxidation products and withdrawn air to the atmosphere.

5. An apparatus for reducing the pressure in a fuel tank ullage having a higher pressure than atmospheric pressure comprising a conduit adapted to be connected to the fuel tank ullage and equipped with a controllable valve, a pressure sensor adapted for mounting to detect the pressure in the fuel tank ullage, a catalyst module having an inlet connected to said conduit, a catalyst in said module, an outlet separated from said inlet by said catalyst, a heater disposed to heat said catalyst, and a temperature sensor to detect the temperature of said catalyst, and a controller adapted to receive inputs from said pressure sensor and said temperature detector and output control signals to said heater to heat said catalyst when said pressure sensor indicates the pressure in the ullage exceeds a threshold and to open said controllable valve to permit withdrawing of volatile hydrocarbons and air from the ullage to said catalyst for oxidation of the volatile hydrocarbons after said temperature sensor indicates said catalyst has reached a temperature at which it catalyzes the oxidation of volatile hydrocarbons to water and carbon dioxide, thereby reducing the pressure in the ullage by oxidation of the volatile hydrocarbons to water and carbon dioxide and release of the water and carbon dioxide and air to atmosphere wherein the volatile hydrocarbons are transported from the fuel tank ullage to the catalyst module by the pressure differential between the tank ullage and atmospheric pressure.

6. A service station installation comprising a fuel storage tank, a plurality of fuel dispensers operatively connected to said storage tank to withdraw liquid fuel from the storage tank and each having a vapor recovery system including a vapor recovery pump to return vapors to an ullage in said storage tank, and an apparatus for reducing the pressure in said fuel tank ullage including a conduit connected to the fuel tank ullage and equipped with a controllable valve, a pressure sensor mounted to detect the pressure in the fuel tank ullage, a catalyst module having an inlet connected to said conduit, a catalyst in said module, an outlet separated from said inlet by said catalyst, a heater disposed to heat said catalyst, and a temperature sensor to detect the temperature of said catalyst, and a controller adapted to receive inputs from said pressure sensor and said temperature detector and output control signals to said heater to heat said catalyst when said pressure sensor indicates the pressure in the ullage exceeds a threshold and to open said controllable valve to permit withdrawing of volatile hydrocarbons and air from the ullage to said catalyst for oxidation of the volatile hydrocarbons after said temperature sensor indicates said catalyst has reached a temperature at which it catalyzes the oxidation of volatile hydrocarbons to water and carbon dioxide, thereby reducing the pressure in the ullage by oxidation of the volatile hydrocarbons to water and carbon dioxide and release of the water and carbon dioxide and air to atmosphere.

7. An apparatus as claimed in claim 6 further comprising a vapor pump associated with said conduit to transport vapors from the ullage through the conduit to said catalyst module and wherein said controller is adapted to actuate said vapor pump when said valve is opened.

8. A method of dispensing fuel comprising storing fuel in a fuel storage tank, dispensing fuel from one of a plurality of fuel dispensers operatively connected to said storage tank including withdrawing liquid fuel from the storage tank while returning fuel vapor through a vapor recovery pump in the dispenser to an ullage in said storage tank, and reducing the pressure in a fuel tank ullage comprising the steps of detecting the pressure in the fuel tank ullage, when the pressure exceeds a threshold, heating a catalyst to a temperature at which it catalyzes volatile hydrocarbons, withdrawing vapor and air from the fuel tank ullage, directing the withdrawn vapor and air to the catalyst for oxidation of the vapor to carbon dioxide and water, and discharging the oxidation products and withdrawn air to the atmosphere.

* * * * *